US006334791B1

(12) United States Patent
Yeh

(10) Patent No.: US 6,334,791 B1
(45) Date of Patent: Jan. 1, 2002

(54) LOAD CONNECTOR

(76) Inventor: Min-Hua Yeh, No. 10,Lane 121,Li-Der Rd., Peito District, Taipei (TW)

( * ) Notice: Subject to any disclaimer, the term of this patent is extended or adjusted under 35 U.S.C. 154(b) by 0 days.

(21) Appl. No.: 09/614,755

(22) Filed: Jul. 12, 2000

(51) Int. Cl.[7] ..... H01R 13/66
(52) U.S. Cl. ..... 439/620; 333/185
(58) Field of Search ..... 439/620, 608, 439/695, 675, 76.1; 333/22, 220, 222, 185, 181, 1, 184; 24/443; 152/417

(56) References Cited

U.S. PATENT DOCUMENTS 4,079,343 A * 3/1978 Nijman ..... 333/79
4,206,963 A * 6/1980 English et al. ..... 339/147 R
4,729,743 A * 3/1988 Farrar et al. ..... 439/276
4,773,880 A * 9/1988 Sutton et al. ..... 439/620
4,789,360 A * 12/1988 Paul et al. ..... 439/620
4,813,891 A * 3/1989 Walters et al. ..... 439/620
4,867,706 A * 9/1989 Tang ..... 439/620
5,179,877 A * 1/1993 Down et al. ..... 81/443
5,571,028 A * 11/1996 Szegda ..... 439/322
5,584,949 A * 12/1996 Ingram ..... 152/417
5,904,596 A * 5/1999 Knaus et al. ..... 439/620

* cited by examiner

*Primary Examiner*—Gary Paumen
*Assistant Examiner*—Phuong Nguyen
(74) *Attorney, Agent, or Firm*—Dougherty & Troxell

(57) ABSTRACT

Load connector including a main body for connecting with output terminal of a distributor, a collar coaxially disposed in the main body and a circuit board coaxially disposed in the collar. The collar has a flange end section and an interface section. The interface section defines an annular groove for receiving the circuit board therein. The circuit board is formed with a through hole in which a central pin is disposed. The outer circumferences of the through hole and the circuit board are respectively electroplated with two annular conductive layers. A chip resistor or a film resistor is disposed between the two conductive layers. The above arrangement greatly shortens the internal using space of the load connector and has good impedance coupling so that an optimal electric appliance property can be achieved. An O-ring is disposed on outer side of the wall of the flange end section of the collar so as to achieve a moisture-tight seal between the load connector and the output terminal.

2 Claims, 3 Drawing Sheets

LOAD CONNECTOR

BACKGROUND OF THE INVENTION (1) Field of the Invention

The present invention relates to a load connector, and more particularly to a load connector in which a circuit board is disposed in the collar and the inner and outer circumferences of the circuit board are respectively electroplated with two annular conductive layers. A chip resistor or a film resistor is disposed between the two conductive layers to shorten the internal using space of the load connector and achieve an optimal electric appliance property.

(2) Description of the Prior Art

In television systems such as cable television system (CATV), closed-circuit television system (STV) and common antenna television system (MATV), coaxial cables are used to transmit the signals to wide customers. Referring to FIGS. 1A and 1B, generally, multiple distributors 10 are disposed on the main trunk of these television systems. The distributors 10 via coaxial cables transmit signals to the customers. However, the number of the customers will not be just equal to the number of the output terminals of the distributors. Therefore, a load connector 12 with impedance coupling is used to connect with the not used output terminal 11 to avoid leakage of the signals which will lead to signal interference. In order to eliminate the signal interference, the load connector is mounted on the not used output terminal to avoid impedance discoupling between the coaxial cable for outputting signals and the coaxial cable of the customers.

Such load connector 12 includes a main body 13 formed with an inner thread section 14 and a receptacle 15. The inner thread section 14 is screwed on a not used output terminal 11. A resistor 16 is positioned in the receptacle 15. A lead 17 at rear end of the resistor 16 extends out of the main body 13 and fixedly soldered on the main body 13. A lead 18 at front end of the resistor 16 extends out of the main body 13 to connect with a contact element of the not used output terminal 11 so as to form impedance coupling.

The requirement for receiving frequency has been higher and higher nowadays. The frequency has been increased from 550 MHz to 1000 MHz or higher. Therefore, the commercially available load connector must be applicable to high frequency. However, the resistor 16 mounted in the conventional load connector 12 is the widely used 75 Ω resistor which has considerably large volume. Therefore, the total length of the load connector 12 is increased relatively. In the case of burglarproof load connector or double-head (male-female head) load connector, the total length thereof will be even longer. The longer the total length of the load connector is, the smaller the back loss of the electric appliance achieved at high frequency is. Such back loss can hardly meet the requirement of U.S. electric appliance specification standard (SCTE) that the back loss should be over 30 dB. Therefore, the excessively long load connector will directly affect the video quality and can hardly meet the requirement of high frequency.

Therefore, it is necessary to provide a load connector which can achieve larger back loss of electric appliance and meet the requirement of high frequency.

SUMMARY OF THE INVENTION

It is therefore a primary object of the present invention to provide a load connector in which a circuit board is disposed in the collar. The inner and outer circumferences of the circuit board are respectively electroplated with two annular conductive layers. A chip resistor or a film resistor is disposed between the two conductive layers to greatly shorten the internal using space of the load connector and achieve a good impedance coupling. Accordingly, the total length of the load connector is shortened to achieve an optimal electric appliance property when connected with the distributor.

It is a further object of the present invention to provide the above load connector in which an O-ring is disposed on outer side of the wall of the flange end section of the collar, whereby when the load connector is connected with the output terminal of the distributor, the O-ring is compressed between the output terminal and the collar to achieve a moisture-tight seal.

The present invention can be best understood through the following description and accompanying drawings wherein:

DETAILED DESCRIPTION OF THE PREFERRED EMBODIMENTS

Figure 1A:
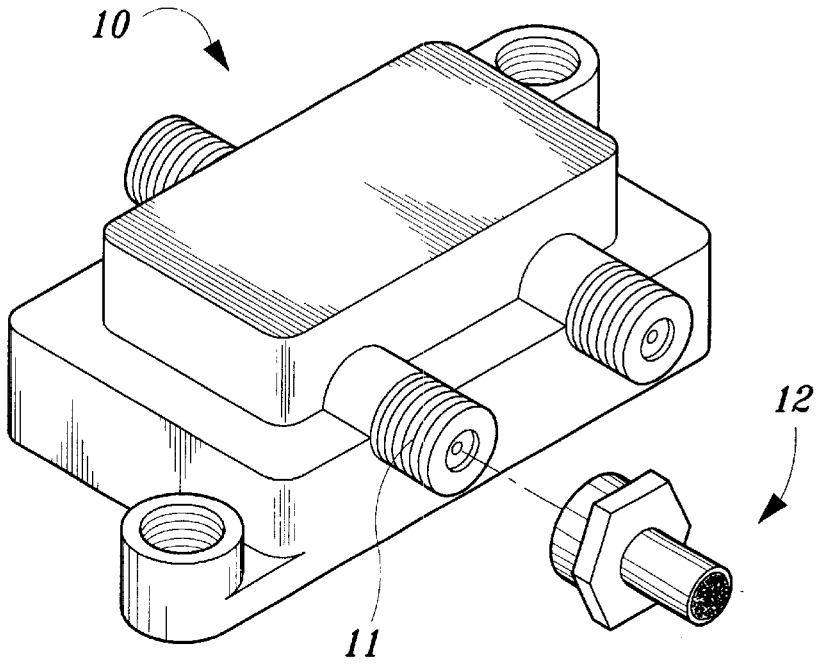
FIG. 1A PRIOR ART
FIG. 1A is a perspective exploded view of a conventional distributor and load connector.
Figure 1B:
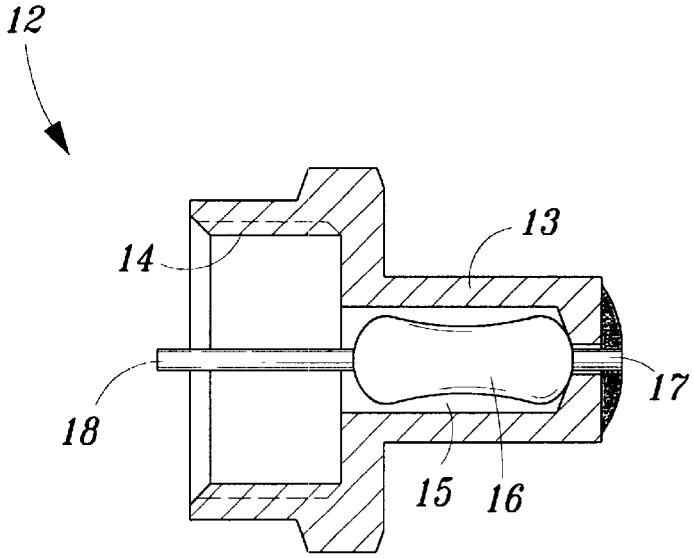
FIG. 1B PRIOR ART
FIG. 1B is a sectional view of a conventional load connector.
Figure 2:
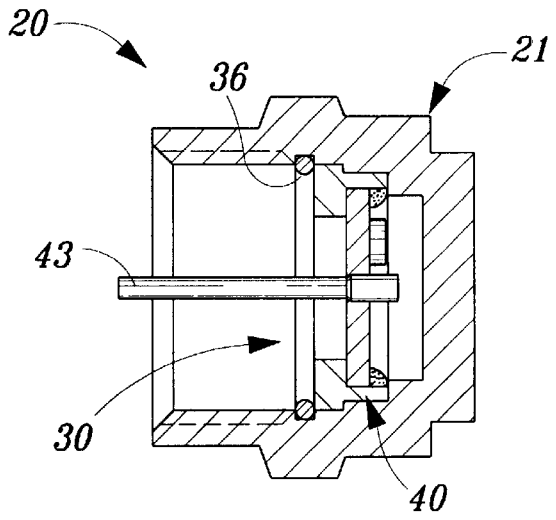
FIG. 2 is a sectional view of the load connector of the present invention.
Figure 4:
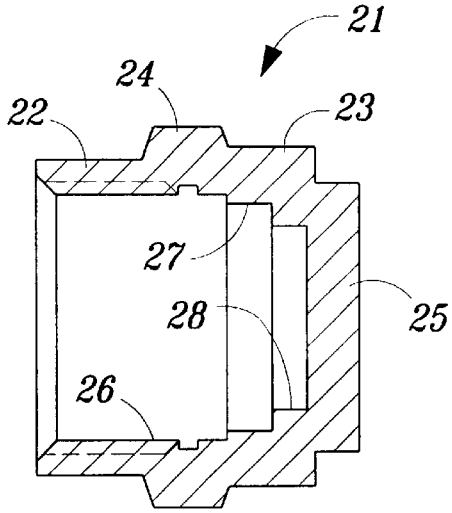
FIG. 4 is a sectional view of the main body of the load connector of the present invention.
Figure 3:
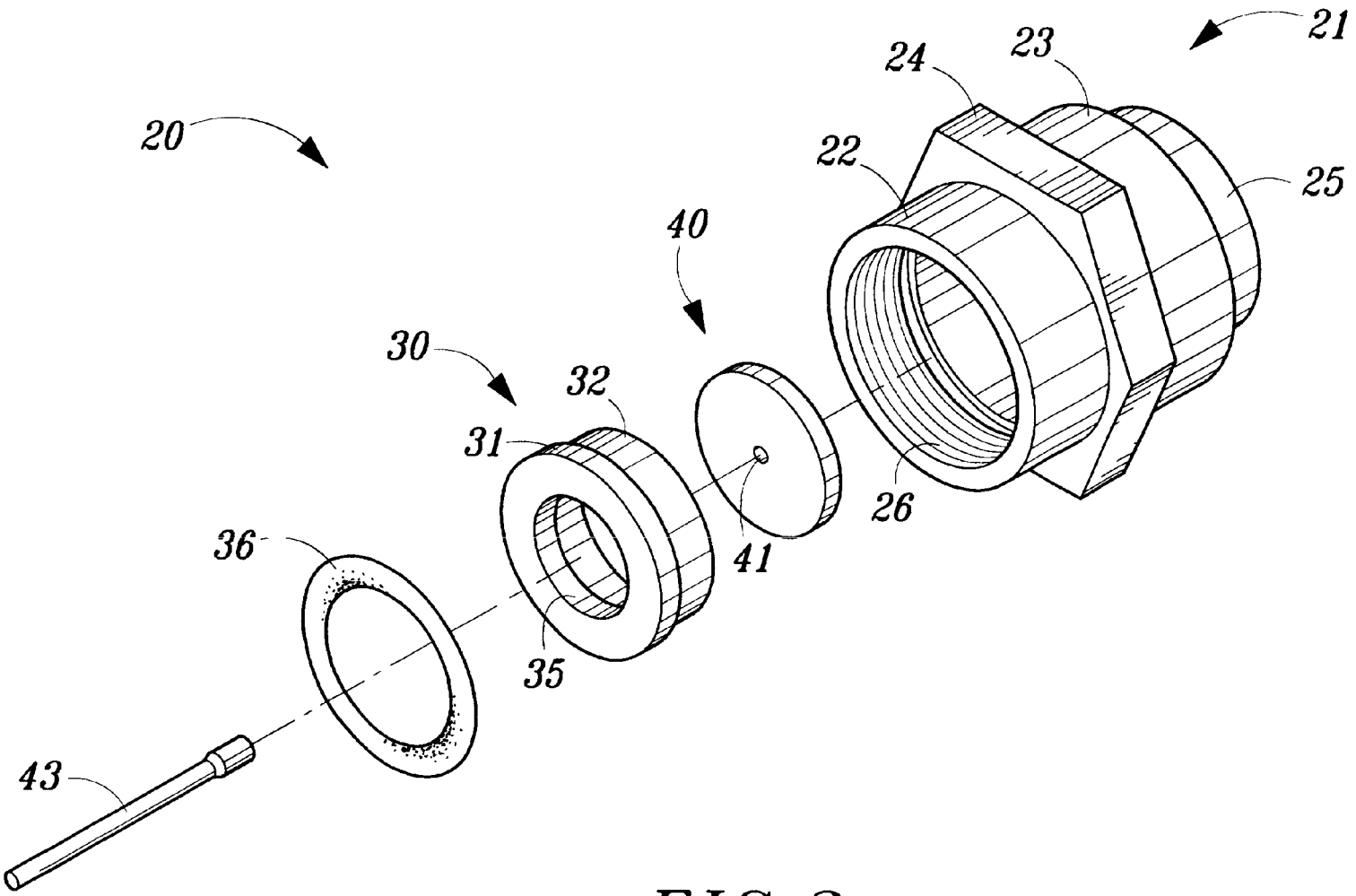
FIG. 3 is a perspective exploded view of the load connector of the present invention.

Please refer to FIGS. 2 and 3. The load connector 20 of the present invention includes a main body 21, a collar 30 coaxially disposed in the main body 21 and a circuit board 40 coaxially disposed in the collar 30. Referring to FIG. 4, the main body 21 is formed with a first tubular end section 22, a second tubular end section 23, a hexagonal body section 24 and a lateral end section 25. The first tubular end section 22 is formed with an inner thread 26 and two annular sections 27, 28. The inner thread 26 is able to connect with an output terminal of a distributor and ends at an annular section 26.

Figure 5:
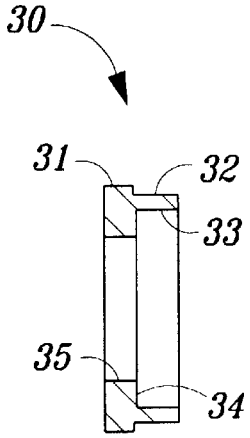
FIG. 5 is a sectional view of the collar of the load connector of the present invention.

Referring to FIG. 5, the collar 30 has a flange end section 31 and an interface section 32. The interface section 32 defines an annular groove 33 which is such dimensioned as to receive the circuit board 40 therein. The interface section 32 ends at an inner shoulder section 34. The flange end section 31 defines a perforation 35. A sealing member such as an O-ring 36 is disposed on outer side of the wall of the flange end section 31.

Figure 6A:
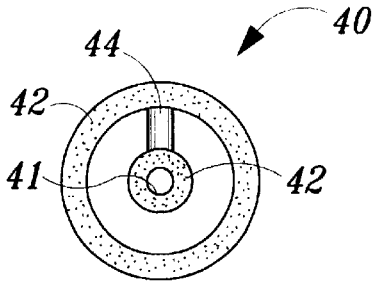
FIG. 6A is a plane view of a first embodiment of the circuit board of the present invention.
Figure 6B:
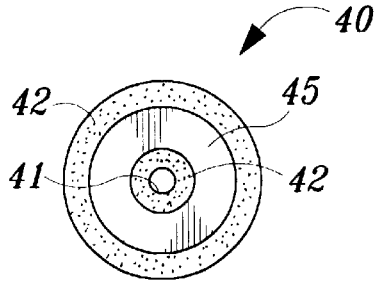
FIG. 6B is a plane view of a second embodiment of the circuit board of the present invention.

Referring to FIG. 6A, the circuit board 40 is positioned in the annular groove 33 and fixedly soldered in the collar 30. The circuit board 40 is formed with a through hole 41 which is such dimensioned as to receive therein a central pin 43. The outer circumferences of the through hole 41 and the circuit board 40 are respectively electroplated with two annular conductive layers 42. At least one chip resistor 44 or a donut-shaped film resistor 45 (as shown in FIG. 6B) is disposed between the two conductive layers 42. When the central pin 43 is inserted into a contact element in the output terminal, an impedance coupling is formed.

When the inner thread 26 of the load connector 20 is connected with the output terminal of the distributor, the O-ring is compressed between the output terminal and the collar 30 to form a moisture-tight seal for preventing moisture from entering the connector 20 to interfere with the video quality.

In the load connector 20 of the present invention, the chip resistor 44 or film resistor 45 is associated with the circuit board 40 so as to greatly shorten the internal using space and thus change the total length of the load connector 20. Accordingly, the back loss of electric appliance is over 30 dB and an optimal electric appliance property can be achieved to meet U.S. electric appliance specification standard.

The above embodiments are only used to illustrate the present invention, not intended to limit the scope thereof. Many modifications of the above embodiments can be made without departing from the spirit of the present invention.

What is claimed is:

1. Load connector for connecting with output terminal of a distributor to form impedance coupling, comprising:

a main body formed with an inner thread and annular section;

a collar coaxially disposed in the annular section of the main body, having a flange end section and an interface section, the interface section defining an annular groove; and a circuit board coaxially disposed in the annular groove of the interface section, the circuit board being formed with a through hole for receiving therein a central pin, outer circumferences of the through hole and the circuit board being respectively electroplated with two annular conductive layers, at least one chip resistor or a film resistor being disposed between the two conductive layers.

2. Load connector as claimed in claim 1, wherein an O-ring is disposed between the inner thread and the annular section of the main body, whereby when the load connector is connected with the output terminal of the distributor, the O-ring is compressed between the output terminal and the collar to form a moisture-tight seal.

* * * * *